US009093066B2

(12) United States Patent
Bessette

(10) Patent No.: US 9,093,066 B2
(45) **Date of Patent: *Jul. 28, 2015**

(54) FORWARD TIME-DOMAIN ALIASING CANCELLATION USING LINEAR-PREDICTIVE FILTERING TO CANCEL TIME REVERSED AND ZERO INPUT RESPONSES OF ADJACENT FRAMES

(75) Inventor: Bruno Bessette, Sherbrooke (CA)

(73) Assignee: VOICEAGE CORPORATION, Town of Mount Royal Quebec (CA)

( * ) Notice: Subject to any disclaimer, the term of this patent is extended or adjusted under 35 U.S.C. 154(b) by 618 days.

This patent is subject to a terminal disclaimer.

(21) Appl. No.: 13/006,168

(22) Filed: Jan. 13, 2011

(65) Prior Publication Data

US 2012/0022880 A1 Jan. 26, 2012

Related U.S. Application Data

(60) Provisional application No. 61/294,688, filed on Jan. 13, 2010.

(51) Int. Cl.
*G10L 19/00* (2013.01)
*G10L 21/00* (2013.01)
(Continued)

(52) U.S. Cl.
CPC ..... *G10L 19/022* (2013.01); *G10L 19/0212* (2013.01); *G10L 19/18* (2013.01); *G10L 19/008* (2013.01); *G10L 19/06* (2013.01); *G10L 19/12* (2013.01); *G10L 21/04* (2013.01)

(58) Field of Classification Search
CPC ..... G10L 19/008; G10L 21/04; G10L 19/12
USPC ..... 704/201, 500
See application file for complete search history.

(56) References Cited

U.S. PATENT DOCUMENTS 5,297,236 A 3/1994 Antill et al.
6,134,518 A 10/2000 Cohen et al.
(Continued)

FOREIGN PATENT DOCUMENTS

CN 1 672 418 9/2005
CN 1 954 367 4/2007
(Continued)

OTHER PUBLICATIONS

Bessette. et al., "Universal Speech/Audio Coding Using Hybrid ACELP/TCX Techniques", IEEE Conference, Philadelphia, PA, Mar. 18, 2005, pp. 301-304.
(Continued)

*Primary Examiner* — Farzad Kazeminezhad
(74) *Attorney, Agent, or Firm* — Fay Kaplun & Marcin, LLP

(57) ABSTRACT

In a coder, a method for producing forward aliasing cancellation (FAC) parameters for cancelling time-domain aliasing caused to a coded audio signal in a first transform-coded frame by a transition between the first transform-coded frame using a first coding mode with overlapping window and a second frame using a second coding mode with non-overlapping window, comprising: calculating a FAC target representative of a difference between the audio signal of the first frame prior to coding and a sum of synthesis of the coded audio signal of the first transform-coded frame and a time reversed version of last synthesis samples of the second frame as well as a zero point response of a synthesis filter used in the second frame; and weighting the FAC target to produce the FAC parameters. In a decoder, weighted forward aliasing cancellation (FAC) parameters are received and inverse weighted to produce a FAC synthesis. Upon synthesis of the coded audio signal in the first frame, the time-domain aliasing is cancelled from the audio signal synthesis using the FAC synthesis.

41 Claims, 8 Drawing Sheets

(51) Int. Cl.

| | |
|---|---|
| ***G10L 19/12*** | (2013.01) |
| ***G10L 19/022*** | (2013.01) |
| ***G10L 19/02*** | (2013.01) |
| ***G10L 19/18*** | (2013.01) |
| *G10L 21/04* | (2013.01) |
| *G10L 19/008* | (2013.01) |
| *G10L 19/06* | (2013.01) |

(56) References Cited

U.S. PATENT DOCUMENTS

| | | | | |
|---|---|---|---|---|
| 6,246,645 | B1 | 6/2001 | Tsutsui | |
| 6,314,393 | B1 * | 11/2001 | Zheng et al. | 704/223 |
| 6,327,691 | B1 | 12/2001 | Huang | |
| 6,475,245 | B2 | 11/2002 | Gersho et al. | |
| 7,873,227 | B2 | 1/2011 | Geiger et al. | |
| 2001/0023396 | A1 | 9/2001 | Gersho et al. | |
| 2004/0024588 | A1 | 2/2004 | Watson et al. | |
| 2005/0185850 | A1 | 8/2005 | Vinton et al. | |
| 2008/0195383 | A1 | 8/2008 | Shlomot et al. | |
| 2009/0299757 | A1 * | 12/2009 | Guo et al. | 704/500 |
| 2011/0173011 | A1 * | 7/2011 | Geiger et al. | 704/500 |
| 2011/0257981 | A1 * | 10/2011 | Beack et al. | 704/500 |

FOREIGN PATENT DOCUMENTS

| | | |
|---|---|---|
| CN | 101 231 850 | 7/2008 |
| EP | 2 144 171 | 1/2010 |
| JP | 2012/118517 | 4/2002 |
| JP | 2007/526691 | 9/2007 |
| RU | 2 323 469 | 4/2008 |
| RU | 2 326 449 | 6/2008 |
| WO | 2004/006226 | 1/2004 |
| WO | 2005/114654 | 12/2005 |
| WO | 2008/089705 | 7/2008 |
| WO | 2009/093466 | 7/2009 |
| WO | 2009/113316 | 9/2009 |
| WO | 2010/148516 | 12/2010 |
| WO | 2011/044700 | 4/2011 |
| WO | 2011/048117 | 4/2011 |
| WO | 2012/004349 | 1/2012 |

OTHER PUBLICATIONS

Lecomte et al., "Efficient cross-fade windows for transitions between LPC-based and non-LPC based audio coding", 126$^{th}$ Audio Engineering Society Convention Paper 7712, Munich, Germany May 7, 2009, pp. 1-9.

Princen et al., "Analysis/Synthesis Filter Bank Design Based on Time Domain Aliasing Cancellation", IEEE Transactions on Acoustics, Speech and Signal Processing, vol. ASSP-34, No. 5, Oct. 1986, pp. 1153-1161.

Princen et al., "Subband/Transform Coding Using Filter Bank Designs Based on Time Doman Aliasing Cancellation", IEEE International Conference on Acoustics, Speech and Signal Processing, vol. 12, 1987, pp. 2161-2164.

Ferreira, "Convolutional Effects in Transform Coding with TDAC: An Optimal Window", IEEE Transactions on Speech and Audio Processing, vol. 4, No. 2, Mar. 1996, pp. 104-114.

Neundorf et al., "A Novel Scheme for Low Bitrate Unified Speech and Audio Coding-MPEG RM0", 126$^{th}$ Audio Engineering Society Convention Paper 7713, Munich, Germany , May 7, 2009, pp. 1-13.

Neundorf et al., "Unified Speech and Audio Coding Scheme for High Quality at Low Bitrates", IEEE International Conference on Acoustics, Speech and Signal Processing, 2009, pp. 1-4.

Information Technology—MPEG audio technologies—Part 3: Unified Speech and Audio Coding, ISO/IEC JTC 1/SC 29N, 2010, pp. 1-158.

3$^{rd}$ Generation Partnership Project; Technical Specification Group Service and System Aspects; Audio codec processing functions; Extended Arm Wideband codec; Transcoding functions (Release 6), Jun. 2004, pp. 1-72.

International Standard, ISO/IEC 14496-3, Information technology—coding of audio-visual objects—Part 3 Audio, 2005, pp. 1-1178.

Neuronorf et al., "Completion of Core Experiment on Unification of USAC Windowing and Frame Transitions", 91. MPEG Meeting; 18-1-2010-22-1-2010; Kyoto; (Motion picture Expert Group or ISO/IEC JTC1/SC29/WG11), No. M17167, Jan. 16, 2010, XP030045757, 52 pgs.

Bessette et al., "Alternatives for windowing in USAC", 89., MPEG Meeting; Jun. 29, 2009-Jul. 3, 2009; London; (Motion Picture Expert Group or ISO/IEC JTC1/SC29/WG11), No. M16688, Jun. 29, 2009, (XP030045285), 12 pgs.

* cited by examiner

FORWARD TIME-DOMAIN ALIASING CANCELLATION USING LINEAR-PREDICTIVE FILTERING TO CANCEL TIME REVERSED AND ZERO INPUT RESPONSES OF ADJACENT FRAMES

TECHNICAL FIELD

The present disclosure relates to the field of coding and decoding audio signals. More specifically, the present disclosure relates time-domain aliasing cancellation in a coded audio signal.

BACKGROUND

State-of-the-art audio coding uses time-frequency decomposition to represent the signal in a meaningful way for data reduction. More specifically, audio coders use transforms to perform a mapping of the time-domain samples into frequency-domain coefficients. Discrete-time transforms used for this time-to-frequency mapping are typically based on kernels of sinusoidal functions, such as the Discrete Fourier Transform (DFT) and the Discrete Cosine Transform (DCT). It can be shown that such transforms achieve energy compaction of the audio signal. Energy compaction means that, in the transform (or frequency) domain, the energy distribution is localized on fewer significant frequency-domain coefficients than in the time-domain samples. Coding gains can then be achieved by applying adaptive bit allocation and suitable quantization to the frequency-domain coefficients. At the receiver, the bits representing the quantized and coded parameters (including the frequency-domain coefficients) are used to recover the quantized frequency-domain coefficients (or other quantized data such as gains), and the inverse transform generates the time-domain audio signal. Such coding schemes are generally referred to as transform coding.

By definition, transform coding operates on consecutive blocks (usually called "frames") of samples of the input audio signal. Since quantization introduces some distortion in each synthesized block of audio signal, using non-overlapping blocks may introduce discontinuities at the block boundaries which may degrade the audio signal quality. Hence, in transform coding, to avoid discontinuities, the coded blocks of audio signal are overlapped prior to applying the transform, and appropriately windowed in the overlapping segment to allow smooth transition from one decoded block of samples to the next. Using a transform such as the DFT (or its fast equivalent, the Fast Fourier Transform (FFT)) or the DCT and applying it to overlapped blocks of samples unfortunately results in what is called "non-critical sampling". For example, taking a typical 50% overlap condition, coding a block of N consecutive time-domain samples actually requires taking a transform on 2N consecutive samples, including N samples from the present block and N samples from the preceding and next block overlapping parts. Hence, for every block of N time-domain samples, 2N frequency-domain coefficients are coded. Critical sampling in the frequency domain implies that N input time-domain samples produce only N frequency-domain coefficients to be quantized and coded.

Specialized transforms have been designed to allow the use of overlapping windows and still maintain critical sampling in the transform-domain. With such specialized transforms, the 2N time-domain samples at the input of the transform result in N frequency-domain coefficients at the output of the transform. To achieve this, the block of 2N time-domain samples is first reduced to a block of N time domain samples through special time inversion, summation of specific parts of the 2N-sample long windowed signal at one end of the window, and subtraction of specific parts of the 2N-sample long windowed signal from each other at the other end of the window. These special time inversion, summation and subtraction introduce what is called "time-domain aliasing" (TDA). Once TDA is introduced in the block of samples of the audio signal, it cannot be removed using only that block. It is this time-domain aliased signal that is the input of a transform of size N (and not 2N), producing the N frequency-domain coefficients of the transform. To recover the N time-domain samples, the inverse transform uses the transform coefficients from two consecutive and overlapping frames or blocks to cancel out the TDA, in a process called Time-domain aliasing cancellation (TDAC).

An example of such a transform applying TDAC, which is widely used in audio coding, is the Modified Discrete Cosine Transform (MDCT). Actually, the MDCT introduces TDA without explicit folding in the time domain. Rather, time-domain aliasing is introduced when considering both the direct MDCT and inverse MDCT (IMDCT) of a single block of samples. This comes from the mathematical construction of the MDCT and is well known to those of ordinary skill in the art. But it is also known that this implicit time-domain aliasing can be seen as equivalent to first inverting parts of the time-domain samples and adding (or subtracting) these inverted parts to other parts of the signal. This is known as "folding".

A problem arises when an audio coder switches between two coding modes, one using TDAC and the other not. Suppose for example that a codec switches from a TDAC coding mode to a non-TDAC coding mode. The side of the block of samples coded using the TDAC coding mode, and which is common to the block coded without using TDAC, contains TDA which cannot be cancelled out using the block of samples coded using the non-TDAC coding mode.

A first solution is to discard the samples which contain aliasing that cannot be cancelled out.

This first solution results in an inefficient use of transmission bandwidth because the block of samples for which TDA cannot be cancelled out is coded twice, once by the TDAC-based codec and a second time by the non-TDAC based codec.

A second solution is to use specially designed windows which do not introduce TDA in at least one part of the window when the time inversion and summation/subtraction process is applied. FIG. 1 is a diagram of an example of 2N-sample window introducing TDA on its left side but not on its right side. The window 100 of FIG. 1 is useful for transitions from a TDAC-based codec to a non-TDAC based codec. The first half of the window 100 is shaped so that it introduces TDA 110, which can be cancelled if the previous window also uses TDA with overlapping. However, the right side of the window 100 in FIG. 1 has a zero-valued region 120 after the folding point at position 3N/2. This region 120 of the window 100 therefore does not introduce any TDA when the time-inversion and summation/subtraction (or folding) process is performed around the folding point at position 3N/2.

As illustrated in FIG. 1, the window 100 contains a flat region 130 preceded by a left-side tapered region 140. The purpose of the tapered region 140 is to provide a good spectral resolution when the transform is computed and to smooth the transition during overlap-and-add operations between adjacent blocks. Increasing the duration of the flat region 130 of the window 100 reduces the overhead of information. However, the region 120 decreases the spectral performance of the window 100 since zero-valued sample information only is conveyed in region 120.

Therefore, there is a need for an improved TDAC technique usable, for example, in the multi-mode Moving Pictures Expert Group (MPEG) Unified Speech and Audio Codec (USAC), to manage the different transitions between frames using rectangular, non-overlapping windows and frames using non-rectangular, overlapping windows, while ensuring proper spectral resolution, data overhead reduction and smoothness of transition between these different frame types.

SUMMARY

Therefore, there is a need for an aliasing cancellation technique for supporting switching between coding modes, wherein the technique compensates for aliasing effects at a switching point between these modes.

Therefore, according to a first aspect, there is provided a method for producing forward aliasing cancellation (FAC) parameters for cancelling time-domain aliasing caused to a coded audio signal in a first transform-coded frame by a transition between the first transform-coded frame using a first coding mode with overlapping window and a second frame using a second coding mode with non-overlapping window, comprising: calculating a FAC target representative of a difference between the audio signal of the first frame prior to coding and a synthesis of the coded audio signal of the first transform-coded frame; and weighting the FAC target to produce the FAC parameters.

According to a second aspect, there is provided a method for forward cancelling time-domain aliasing caused to a coded audio signal in a first transform-coded frame by a transition between the first transform-coded frame using a first coding mode with overlapping window and a second frame using a second coding mode with non-overlapping window, comprising: receiving weighted forward aliasing cancellation (FAC) parameters; inverse weighting the weighted FAC parameters to produce a FAC synthesis; and upon synthesis of the coded audio signal in the first frame, cancelling the time-domain aliasing from the audio signal synthesis using the FAC synthesis.

According to a third aspect, there is provided a device for producing forward aliasing cancellation (FAC) parameters for cancelling time-domain aliasing caused to a coded audio signal in a first transform-coded frame by a transition between the first transform-coded frame using a first coding mode with overlapping window and a second frame using a second coding mode with non-overlapping window, comprising: a calculator of a FAC target representative of a difference between the audio signal of the first frame prior to coding and a synthesis of the coded audio signal of the first transform-coded frame; and a weighting filter supplied with the FAC target to produce the FAC parameters.

According to a fourth aspect, there is provided an audio signal coder, comprising: a first coder of the audio signal in a first transform coding mode using frames with overlapping windows; a second coder of the audio signal in a second coding mode using frames with non-overlapping windows; and a device as defined hereinabove for producing FAC parameters for cancelling time-domain aliasing caused to the audio signal coded in the first coding mode in a first frame with overlapping window by a transition between the first frame using the first coding mode with overlapping window and a second frame using the second coding mode with non-overlapping window.

According to a fifth aspect, there is provided a device for forward cancelling time-domain aliasing caused to a coded audio signal in a first transform-coded frame by a transition between the first transform-coded frame using a first coding mode with overlapping window and a second frame using a second coding mode with non-overlapping window, comprising: an input for receiving weighted forward aliasing cancellation (FAC) parameters; an inverse weighting filter supplied with the weighted FAC parameters to produce a FAC synthesis; and a decoder of the coded audio signal responsive to the FAC synthesis to produce in the first frame an audio signal synthesis with cancelled time-domain aliasing.

According to a fifth aspect, there is provided an audio signal decoder, comprising: a first decoder of the audio signal coded in a first transform coding mode using frames with overlapping windows; a second decoder of the audio signal coded in a second coding mode using frames with non-overlapping windows; and a device as defined hereinabove for forward cancelling time-domain aliasing caused to the audio signal coded using the first coding mode in a frame with overlapping window by a transition between the first frame using the first coding mode with overlapping window and a second frame using the second coding mode with non-overlapping window.

The foregoing and other features will become more apparent upon reading of the following non-restrictive description of illustrative embodiments of the device and method for forward cancelling time-domain aliasing, given by way of example only with reference to the accompanying drawings.

DETAILED DESCRIPTION

The following disclosure addresses the problem of cancelling the effects of time-domain aliasing and non-rectangular windowing when an audio signal is coded using both overlapping and non-overlapping windows in contiguous frames. Using the technology described herein the use of special, non-optimal windows may be avoided while still allowing proper management of frame transitions between coding modes using both rectangular, non-overlapping windows and non-rectangular, overlapping windows.

Linear Predictive (LP) coding, for example ACELP (Algebraic Code-Excited Linear Prediction) coding, is an example of coding mode in which a frame is coded using rectangular, non-overlapping windowing. Alternatively, an example of coding mode using non-rectangular, overlapping windowing is Transform Coded eXcitation (TCX) coding as applied in the MPEG Unified Speech and Audio Codec (USAC). Another example of coding mode using non-rectangular, overlapping windowing is perceptual transform coding as in the FD mode of USAC, where an MDCT is also used as a transform and a perceptual model is used to dynamically allocate the bits to the transform coefficients. In USAC, TCX frames use both overlapping windows and Modified Discrete Cosine Transform (MDCT), which introduces Time Domain Aliasing (TDA). USAC is also a typical example where contiguous frames can be coded using either rectangular, non-overlapping windows such as in ACELP frames, or non-rectangular, overlapping windows, such as in TCX frames. Without loss of generality, the present disclosure thus considers the specific example of USAC to illustrate the benefits of the device and method for forward cancelling time-domain aliasing.

Two distinct cases are addressed in the present disclosure. The first case is concerned with a transition from a frame using a rectangular, non-overlapping window to a frame using a non-rectangular, overlapping window. The second case is concerned with a transition from a frame using a non-rectangular, overlapping window to a frame using a rectangular, non-overlapping window. For the purpose of illustration and without suggesting limitation, frames using a rectangular, non-overlapping window may be coded using the ACELP coding mode, and frames using a non-rectangular, overlapping window may be coded using the TCX coding mode. Further, specific durations may be used for some frames, for example 20 milliseconds for a TCX frame, noted TCX20. However, it should be kept in mind that these examples are used only for illustration purposes, and that other frame lengths and coding modes other than ACELP and TCX can be contemplated.

Figure 1:
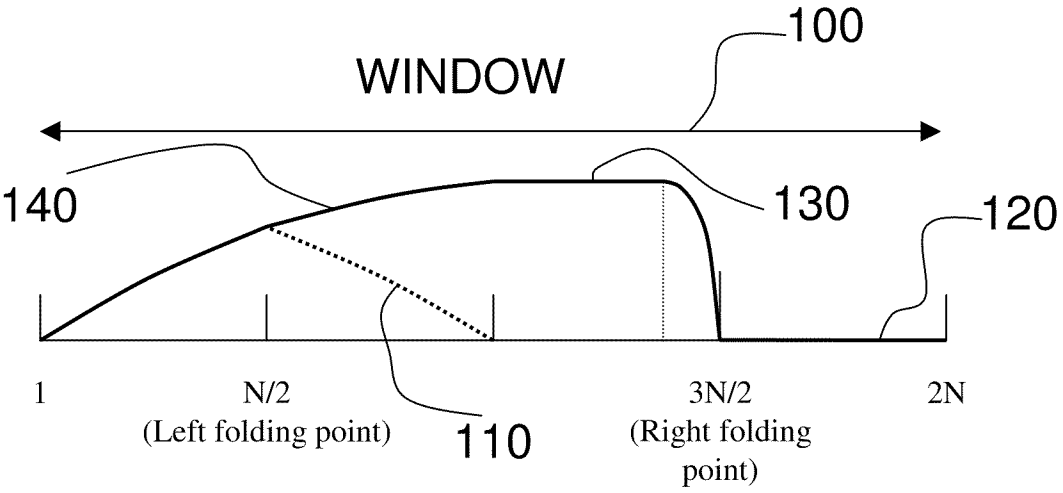
FIG. 1 is a schematic diagram of an example of window introducing TDA on its left side but not on its right side.
Figure 2:
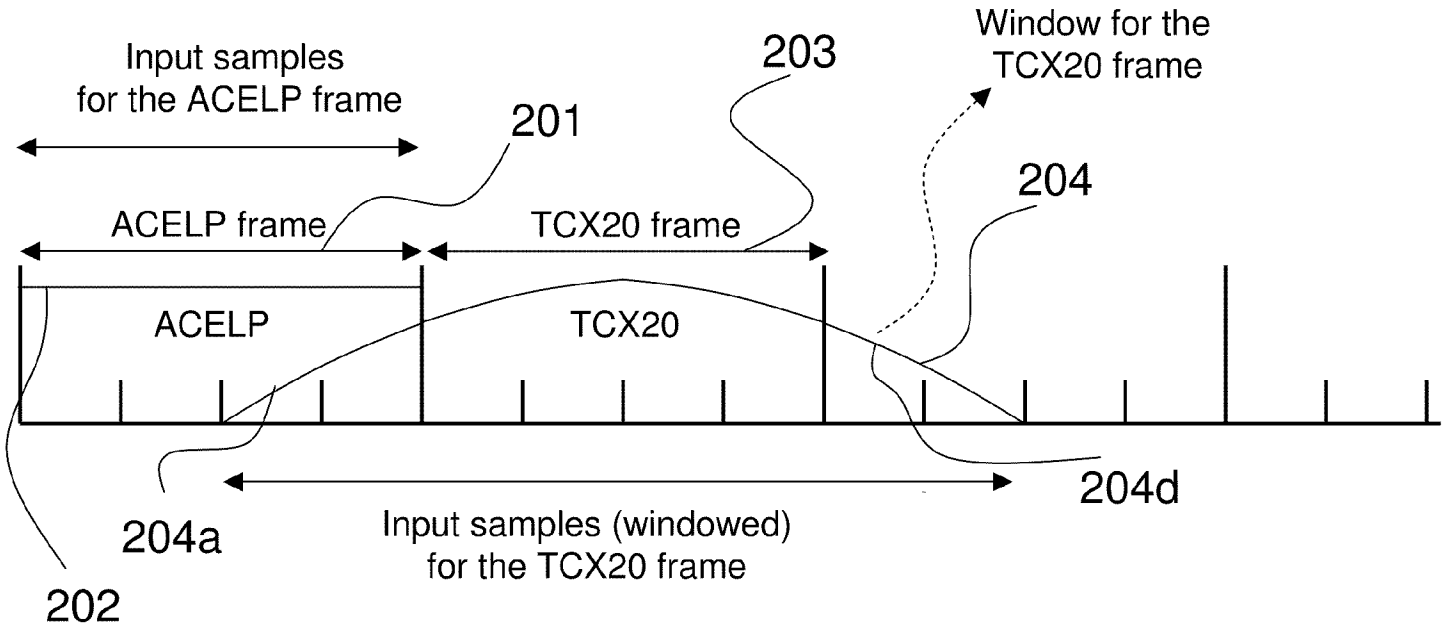
FIG. 2 is a schematic diagram of an example of transition from a frame using a non-overlapping rectangular window to a frame using an overlapping window.

The case of a transition from a frame with rectangular, non-overlapping window to a frame with non-rectangular, overlapping window will now be addressed in relation to the following description taken in conjunction with FIG. 2, which is a schematic diagram of an example of transition from a frame using a non-overlapping rectangular window to a frame using an overlapping window.

More specifically, FIG. 2 illustrates an example of ACELP frame 201 using a rectangular, non-overlapping window 202 and an example of TCX20 frame 203 using a non-rectangular, overlapping window 204. TCX20 refers to the short TCX frames in USAC, which nominally have a 20 ms duration, as do the ACELP frames in many applications. FIG. 2 shows which samples are used in each frame, and how they are windowed at a coder. The same window 204 is applied at a decoder, such that the combined effect seen at the decoder is the square of the window shape shown in FIG. 2. Of course, this double windowing, once at the coder and a second time at the decoder, is typical in transform coding. The non-rectangular window 204 for the TCX20 frame 203 shown in FIG. 2 is chosen such that, if the previous and next frames also use overlapping and non-rectangular windows, then the overlapping portions 204*a* and 204*d* of the window 204 are, after the second windowing at the decoder, complementary and allow recovering the "non windowed" signal in the overlapping region of the windows.

Figure 3:
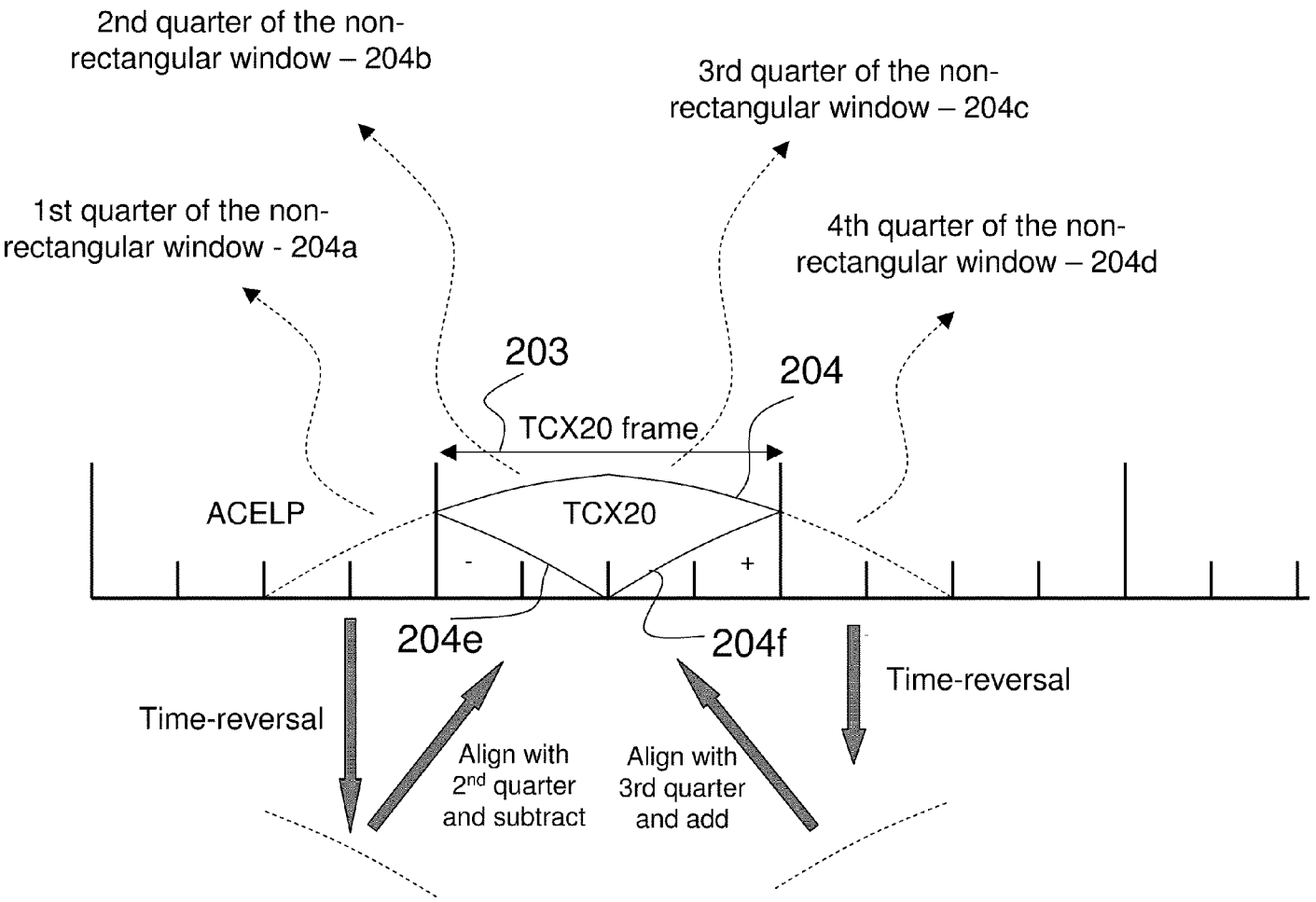
FIG. 3 is a schematic diagram showing folding and TDA applied to the diagram of FIG. 2.

To code the TCX20 frame 203 of FIG. 2 in an efficient manner, time-domain aliasing (TDA) is typically applied to the windowed samples for that TCX20 frame 203. More specifically, the left 204*a* and right 204*d* portions of the window 204 are folded and combined. FIG. 3 is a schematic diagram showing folding and TDA applied to the diagram of FIG. 2. In FIG. 3, the non-rectangular window 204 of FIG. 2 is shown in four quarters. The $1^{st}$ and $4^{th}$ quarters, 204*a* and 204*d* of the window 204 are shown in dotted line as they are combined with the $2^{nd}$ and $3^{rd}$ quarters 204*b*, 204*c*, shown in solid line. Combining the $1^{st}$ and $4^{th}$ quarters 204*a*, 204*d*, to the $2^{nd}$ and $3^{rd}$ quarters 204*b*, 204*c*, uses a process similar to the one used in MDCT coding, as follows. The $1^{st}$ quarter 204*a* is time-reversed, then it is aligned, sample-by-sample, to the $2^{nd}$ quarter 204*b* of the window, and finally the time-reversed and shifted $1^{st}$ quarter 204*e* is subtracted from the $2^{nd}$ quarter 204*b* of the window 203. Similarly, the $4^{th}$ quarter 204*d* of the window is time-reversed and shifted to form the time-reversed and shifted $4^{th}$ quarter 204*f* aligned with the $3^{rd}$ quarter 204*c* of the window 204, and is finally added to the $3^{rd}$ quarter 204*c* of the window 204. If the TCX20 window 204 shown in FIG. 2 has 2N samples, then at the end of this process N samples extending exactly from the beginning to the end of the TCX20 frame 206 of FIG. 3 are obtained. Then these N samples form the input of an appropriate transform for efficient coding in the transform domain. Using the specific time-domain aliasing described in FIG. 3, the MDCT can be the transform used for this purpose.

After the combination of time-reversed and shifted portions of the window described in FIG. 3, it is no longer possible to recover the original time-domain samples in the TCX20 frame because they are mixed with time-reversed versions of samples outside the TCX20 frame. In an MDCT-based audio coder such as MPEG AAC, where all frames are coded using the same transform and overlapping windows, this time-domain aliasing can be cancelled, and the audio samples can be recovered by using two consecutive overlapped frames. However, when contiguous frames do not use the same windowing and overlapping process, as in FIG. 2 where the TCX20 frame (non-rectangular, overlapping window) is preceded by an ACELP frame (rectangular, non overlapping window), the effect of the non-rectangular window and time-domain aliasing cannot be eliminated using only the information from the previous ACELP frame and next TCX20 frame.

Techniques to manage this type of transition were presented hereinabove. The present disclosure proposes an alternative approach to managing these transitions. This approach does not use non-optimal and asymmetric windows in the frames where MDCT-based transform-domain coding is used. Instead, the device and method introduced herein allow the use of symmetric windows, centered at the middle of the coded frame, such as for example the TCX20 frame of FIG. 3, and with 50% overlap with MDCT-coded frames also using non-rectangular windows. The device and method introduced herein thus propose to send from the coder to the decoder, as additional information in the bitstream, correction information to cancel the windowing effect and the time-domain aliasing when switching from frames coded with a rectangular, non-overlapping window and frames coded with a non-rectangular, overlapping window, and vice-versa.

In FIG. 2, rectangular, non-overlapping windowing is shown for an ACELP frame, while non-rectangular, overlapping windowing is shown for a TCX20 frame. Using the TDA introduced in FIG. 3, a decoder receiving at first the bits from the ACELP frame has sufficient information to completely decode this ACELP frame up to its last sample. But then, receiving the bits from the TCX20 frame, properly decoding all the samples in the TCX20 frame is impaired by the time-aliasing effect caused by the presence of the preceding ACELP frame. If a next frame also uses an overlapping window, then the non-rectangular windowing and TDA introduced at the coder can be cancelled in the second half of the shown TCX20 frame and the samples can be decoded properly. It is thus in the first half of the TCX20 frame of FIG. 3, where the time-reversed and shifted 1$^{st}$ quarter 204*e* is subtracted from the 2$^{nd}$ quarter 204*b* that the effect of the non-rectangular window and the TDA introduced at the coder cannot be cancelled since the previous ACELP frame uses a rectangular, non-overlapping window.

The device and method introduced herein propose to transmit additional information in the form of Forward Aliasing Cancellation (FAC) parameters, for cancelling these effects and for properly recovering TCX frames.

An embodiment of particular interest uses Frequency-Domain Noise Shaping (FDNS) for example as in PCT application No. PCT/CA2010/001649 filed on Oct. 15, 2010 and entitled "SIMULTANEOUS TIME-DOMAIN AND FREQUENCY-DOMAIN NOISE SHAPING FOR TDAC TRANSFORMS" to shape the quantization noise in transform-coded frames such as TCX frames. In this embodiment, FAC correction may be applied directly in the original signal domain, such as an audio signal having no weighting applied thereto. In a multi-mode switched codec such as USAC, this implies that quantization noise shaping is performed in the transform domain, for example using MDCT, in all coding modes involving a transform. Specifically, in TCX frames using using FDNS, the transform (MDCT) is applied directly to the original signal (as in perceptual transform coding mode) instead of the weighted residual. FDNS operates in such a way as to obtain a noise shaping in TCX frames which is essentially equivalent to using the time-domain perceptual weighting filter but by only operating on the transform (MDCT) coefficients. The FAC correction may then be applied with the procedure described hereinbelow.

The USAC audio codec is used herein as a non-limiting example of a codec. Three coding modes have been proposed for the USAC codec, as follows:

Coding mode 1: Perceptual transform coding of the original audio signal;

Coding mode 2: Transform coding of the weighted residual of an LPC filter;

Coding mode 3: ACELP coding.

In coding mode 1, quantization noise shaping is already accomplished in the transform domain through the application of scale factors derived from a perceptual model, as is well known by those of ordinary skill in the art of audio coding. In coding mode 2, however, quantization noise shaping is typically applied in the time domain using a perceptual, or weighting, filter W(z) derived from a linear-predictive coding (LPC) filter calculated for the current frame. A transform, for example a DCT transform, is applied after this time-domain filtering to obtain a FAC target to be quantized and coded as FAC parameter. This prevents joining successive frames coded in modes 1 and 2 directly using Time-Domain Aliasing Cancellation (TDAC) properties of the MDCT since the MDCT is not applied in the same domain for coding modes 1 and 2.

Consequently, in an embodiment of the device and method for forward cancelling time-domain aliasing, quantization noise shaping for coding mode 2 is made through frequency-domain filtering using the FDNS process of PCT application No. PCT/CA2010/001649, rather than time-domain filtering. Hence, the transform, which is for example MDCT in the case of USAC, is applied to the original audio signal rather than a weighted version of that audio signal at the output of the filter W(z). This ensures uniformity between coding mode 1 and coding mode 2 and allows joining successive frames coded in modes 1 and 2 using the TDAC property of MDCT.

However, applying the quantization noise shaping in the transform domain for coding mode 2 uses special processing when handling transitions from and to ACELP mode.

Figure 4:
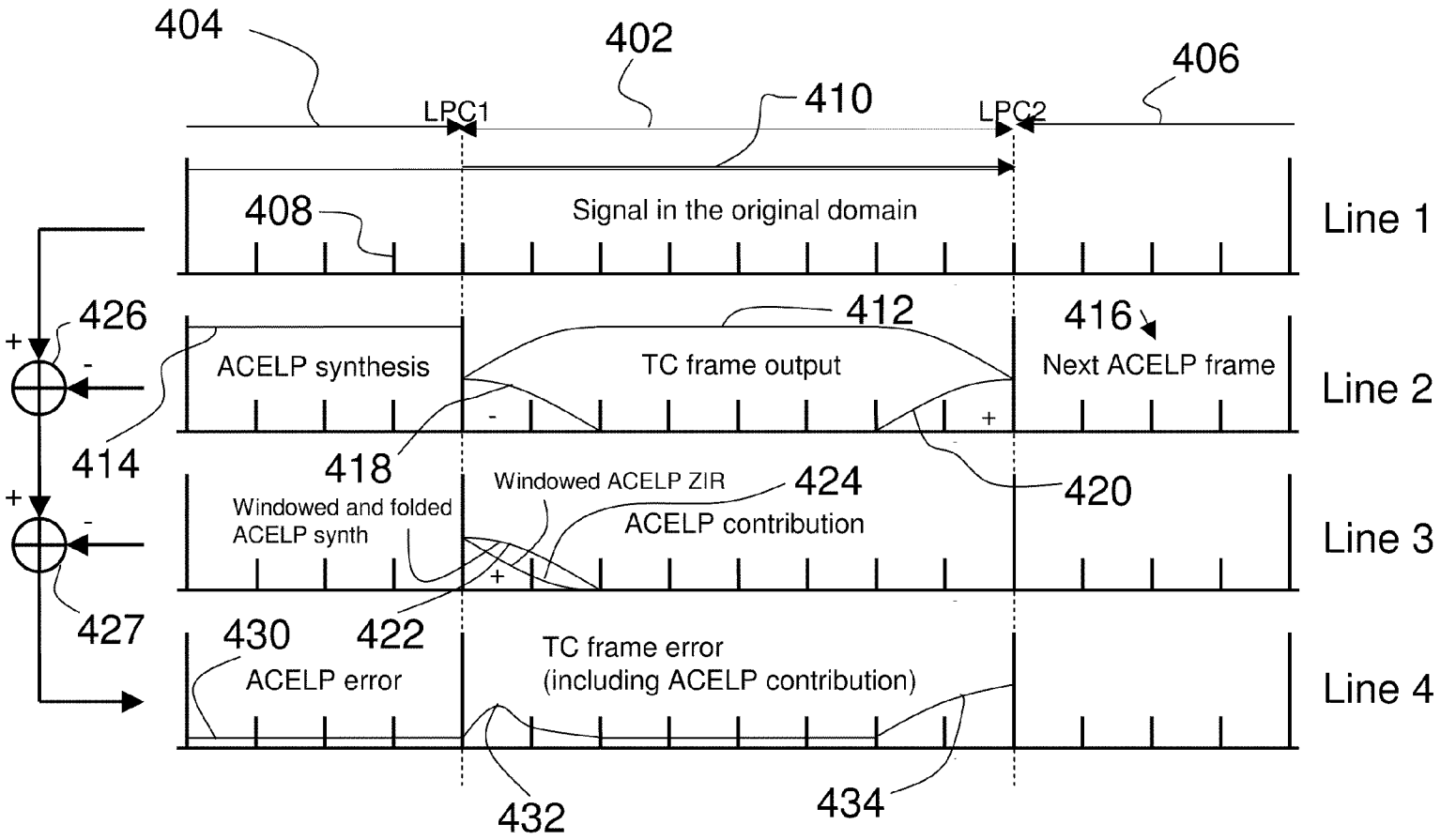
FIG. 4 is a schematic diagram of a sequence of operations of an exemplary method of computing a FAC target.

FIG. 4 is a schematic diagram of a sequence of operations of an exemplary method of computing a FAC target. Processing at the coder is shown when a frame 402 coded in mode 2 is preceded by a frame 404 coded in mode 3 and followed by a frame 406 coded in mode 3, wherein ACELP is used as an example of mode 3 for purposes of illustration only. FIG. 4 shows time-domain markers such as 408 and frame boundaries. Frame boundaries specifically identified with vertical dotted-line markers LPC1 and LPC2 show the beginning and end of the frame 402, which is coded in mode 2. Markers LPC1 and LPC2 further indicate the center of the analysis window to calculate two LPC filters: a first LPC filter is calculated at the beginning of the frame 402 (which also corresponds to the left folding point of the window) and a second LPC filter is calculated at the end of the same frame 402 (which also corresponds to the right folding point of the window).

There are four lines (line 1 to line 4) in FIG. 4. Each line represents an operation in the processing at the coder. As illustrated, lines 1-4 of FIG. 4 are time aligned with each other.

Line 1 of FIG. 4 represents an original audio signal 410, segmented in frames that are delimited by the markers LPC1 and LPC2. Hence, at the left of the marker LPC1, the original audio signal is coded in mode 3. Between markers LPC1 and LPC2, the original audio signal is coded in mode 2, with quantization noise shaping applied directly in the transform domain using the FDNS process for example as in PCT application No. PCT/CA2010/001649 rather than in the time domain. At the right of marker LPC2, the original audio signal is again coded in coding mode 3. This sequence of coding modes, involving ACELP in mode 3, then TCX in mode 2, then again ACELP in mode 3, is chosen so as to illustrate processing related to both transitions from mode 3 to mode 2 and from mode 2 to mode 3. In a multi-mode codec, other mode sequences are of course possible. Obviously, the present disclosure is not limited to the specific mode sequence chosen in the example of FIG. 4.

Line 2 of FIG. 4 corresponds to decoded, synthesis signals 412, 414, 416 in each frame. At the left of marker LPC1 is a synthesis signal 414 of the frame 404 having been coded in mode 3. Hence, the synthesis signal 414 is identified as an ACELP synthesis signal. There is in principle a high similarity between the ACELP synthesis signal 414 and the original signal in the frame 404 since the ACELP coding mode attempts to code and synthesize the audio signal as accurately as possible. Then, the frame 402 between markers LPC1 and LPC2 on line 2 of FIG. 4 represents a synthesis signal 412 obtained as an output of an inverse MDCT (IMDCT) applied to the corresponding frame. FIG. 4 describes an embodiment in which quantization noise shaping in the Transform Coding (TC) frame 402 is accomplished in the transform domain. This can be achieved for example by filtering the MDCT coefficients using spectral information from the above-mentioned first and second LPC filters calculated, as explained hereinabove, at the frame boundaries or markers LPC1 and LPC2. Also, the synthesis signal 412 contains a windowing effect and time-domain aliasing, or folding effect, at the beginning and end of the frame 402. This folding effect is formed by windowed and folded ACELP synthesis portions 418 and 420 from frames 404 and 406, respectively. The windowed and folded ACELP synthesis portions 418 and 420 form two parts of a transform coding error signal. The upper curve of the synthesis signal 412, which extends from beginning to end of the frame 402, shows the windowing effect in the synthesis signal 412, which is relatively flat in the middle but not at the beginning and end of the frame 402. The folding effect is shown by the lower windowed and folded ACELP synthesis portions 418 and 420 at the beginning and end of the frame 402, respectively. The "–" sign associated to the windowed and folded ACELP synthesis portion 418 at the beginning of the frame 402 indicates a subtraction of that windowed and folded ACELP synthesis portion 418 from the synthesis signal 412, while the "+" sign associated to the windowed and folded ACELP synthesis portion 420 at the end of the frame 402 indicates an addition of that windowed and folded ACELP synthesis portion 420 to the synthesis signal 412. This windowing effect and time-domain aliasing, or folding effect, are inherent to the MDCT. This transform coding error signal can be cancelled when consecutive frames are coded using the MDCT, as explained hereinabove. However, in the case where a MDCT-coded frame is not preceded and/or followed by other MDCT-coded frames, this windowing effect and time-domain aliasing, or folding effect, are not cancelled and remains in the time-domain signal after the IMDCT. FAC can then be used to correct these effects. Finally, the frame 406 after marker LPC2 in FIG. 4 is also coded in mode 3, using for example ACELP. To obtain the synthesis signal 416 in that frame 406, filter states in memory of long-term and short-term predictors at the beginning of the frame 406 are set in a manner described hereinbelow, which implies that the windowing and time-domain aliasing, or folding effects at the end of the previous frame 402, between markers LPC1 and LPC2, are cancelled by the application of FAC. To summarize, line 2 in FIG. 4 contains the synthesis signals 414, 412, 416 from the consecutive frames 404, 402, 406, including the transform coding error signal parts 418, 420 caused by windowing and time-domain aliasing at the output the IMDCT in the frame 402 between markers LPC1 and LPC2.

Then, specifics of the exemplary ACELP coding may be used to alleviate at least in part the transform coding error signal induced at the beginning of the synthesis signal 412. A prediction for use in reducing an energy of the transform coding error signal is shown on line 3 of FIG. 4. The prediction is based on an estimate of an eventual ACELP synthesis output, had ACELP been used at the beginning of the frame 402. The prediction is based on an expected self-similarity of the original audio signal 410 immediately before and after the LPC1 marker and may be obtained as follows:

At the beginning of the frame 402 between markers LPC1 and LPC2 of line 3, two contributions from the ACELP synthesis filter states immediately at the left of marker LPC1 may be positioned. A first contribution 422 comprises a windowed and time-reversed, or folded, version of the last ACELP synthesis samples of frame 404. The window length and shape for this time-reversed signal 422 is the same as the windowed and folded ACELP synthesis portion 418 on the left side of the decoded Transform Coding (TC) frame 402 on line 2. This contribution 422 represents a good approximation of the time-domain aliasing present in the TC frame of line 2. A second contribution 424 comprises a windowed zero-input response (ZIR) of the ACELP synthesis filter, with initial states taken as the final states of this filter at the end of the ACELP synthesis frame 404, immediately at the left of marker LPC1. The window length and shape of this second contribution 424 is taken as the complement of the square of the transform window used in the transform-coded frame which, in the exemplary case of USAC, is the MDCT.

Then, having optionally positioned these two prediction contributions (windowed and folded ACELP synthesis 422 and windowed ACELP ZIR 424) on line 3, line 4 is obtained by subtracting line 2 and line 3 from line 1, using adders 426 and 427. It should be noted that the difference computed during this operation stops at marker LPC2. An approximate view of the expected time-domain envelope of the transform coding error signal is shown on line 4. The time-domain envelope of an ACELP coding error 430 in the ACELP frame 404 is expected to be approximately flat in amplitude, provided that the coded signal is stationary for this duration. Then the time-domain envelope of the transform coding error in the TC frame 402, between markers LPC1 and LPC2, is expected to exhibit the general shape as shown in this frame on line 4. This expected shape of the time-domain envelope of the transform coding error is only shown here for illustration purposes and can vary depending on the signal coded in the TC frame between markers LPC1 and LPC2. This illustration of the time-domain envelope of the transform coding error expresses that it is expected to be relatively large near the beginning and end of the TC frame 402, between markers LPC1 and LPC2. At the beginning of the frame 402, where a first FAC target part 432 is shown, the transform coding error is reduced using the two ACELP prediction contributions 422, 424, shown on line 3. This reduction is not present at the end of the TC frame 402, where a second FAC target part 434 is shown. In the second FAC target part 434, the windowing and time-domain aliasing effects cannot be reduced using the synthesis from the next frame, which begins after marker LPC2, since the TC frame 402 needs to be decoded before the next frame can be decoded.

The quantization noise may be typically as the expected envelope of the error signal shown on line 4 of FIG. 4 when the decoder uses only the synthesis signals 414, 412, 416 of line 2 to produce the decoded audio signal. This error comes from the windowing and time-domain aliasing effects inherent to an MDCT/IMDCT pair. The windowing and time-domain aliasing effects have been reduced at the beginning of the TC frame 402 by adding the two contributions from the previous ACELP frame 404 stated above but cannot be completely cancelled as in actual TDAC operation of the MDCT, when TC is used as the only coding mode. Moreover, at the right of the TC frame on line 4 of FIG. 4, just before marker LPC2, all the windowing and time-domain aliasing effects remain from the MDCT/IMDCT pair. The high amplitude parts 432 and 434 of the coding error signal of line 4, at the beginning and end of the TC frame 402, constitute both parts of the FAC target, which is the object of FAC correction.

It is thus understood that parameters for the FAC correction are to be sent to the decoder to compensate for this coding error signal, which affects the beginning and end of the TC frame 402. Windowing and aliasing effects are cancelled in a manner that maintains the quantization noise at a proper level, similar to that of the ACELP frame, and that avoids discontinuities at the boundaries between the TC frame 402 and frames coded in other modes such as 404 and 406. These effects can be cancelled using FAC in the frequency-domain. This is accomplished by filtering the MDCT coefficients using information derived from the first and second LPC filters calculated at the boundaries LPC1 and LPC2, although other Frequency-Domain Noise Shaping (FDNS) can also be used.

Figure 5:
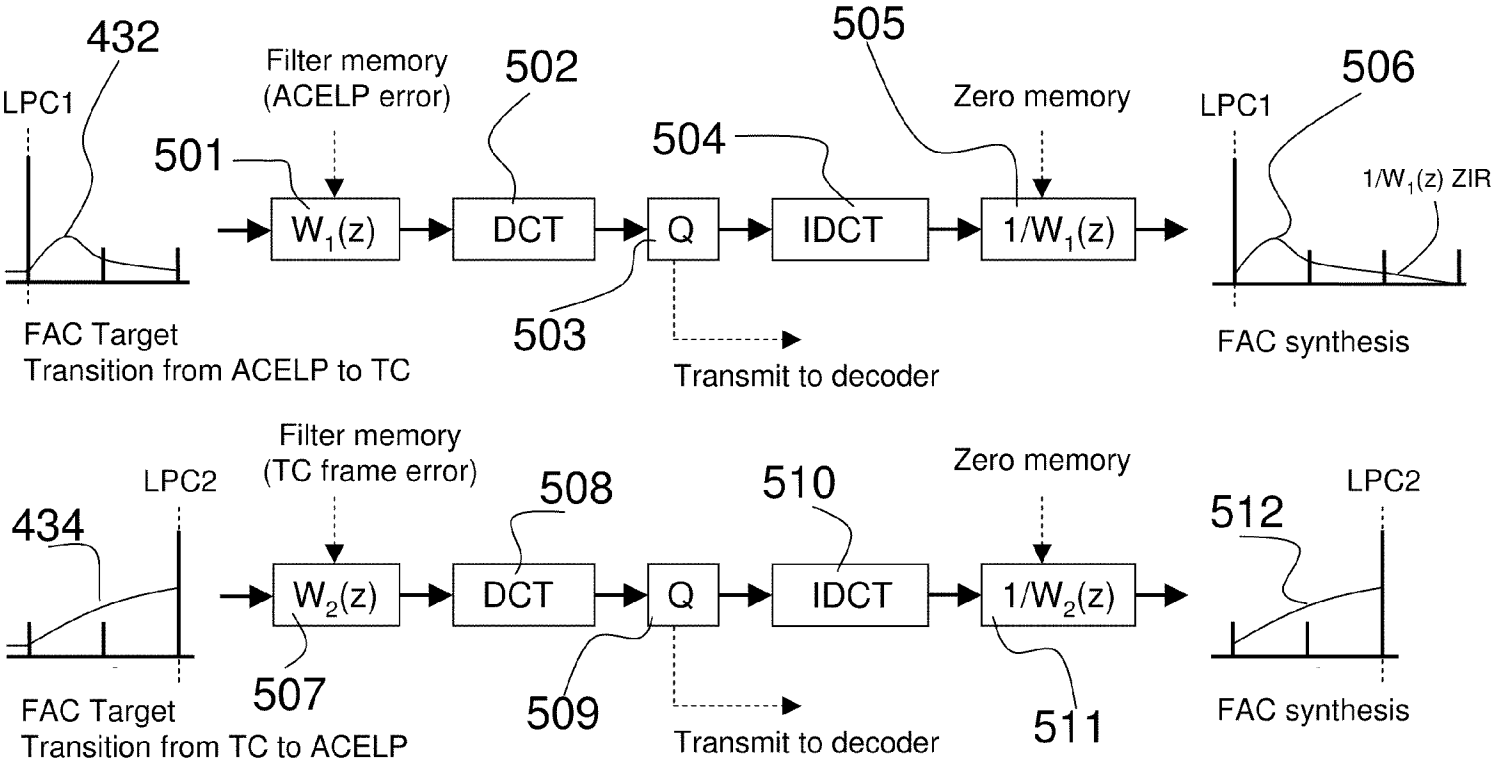
FIG. 5 is a schematic block diagram showing quantization of the FAC target of FIG. 4.

To efficiently compensate the windowing and time-domain aliasing effects at the beginning and end of the TC frame 402 on line 4 of FIG. 4, FAC is applied following the processing described in FIG. 4. FIG. 5 is a block diagram showing quantization of the FAC target of FIG. 4. Quantization as shown in FIG. 5 is of particular interest in the case of the FDNS process for example as in PCT application No. PCT/

CA2010/001649. The FAC quantizes the transform coding error in the weighted domain using LPC at the frame boundary. A potential discontinuity due to quantization is then masked by inverse filtering. This processing is described for both the left part of the TC frame 402, around marker LPC1, and for the right part of the TC frame 402, around marker LPC2. As mentioned hereinabove, the TC frame 402 of FIG. 4 is preceded by an ACELP frame 404, at the LPC1 marker boundary, and followed by an ACELP frame 406, at the LPC2 marker boundary.

To compensate for the windowing and time-domain aliasing effects around marker LPC1, the processing can be as described at the top of FIG. 5. First, in the case of FDNS, a weighting filter $W_1(z)$ 501 may be computed from the first LPC filter calculated at the frame boundary LPC1, or from an interpolated LPC filter using both the first LPC filter calculated at frame boundary LPC1 and the second LPC filter calculated at frame boundary LPC2. The first FAC target part 432, from the beginning of the TC frame 402 on line 4 of FIG. 4, is filtered through the weighting filter $W_1(z)$ 501. The weighting filter $W_1(z)$ has as an initial state, or filter memory, constituted by the ACELP error 430 shown on line 4 of FIG. 4. The output of filter $W_1(z)$ 501 of FIG. 5 then forms the input of a transform, for example an DCT 502. Transform coefficients from the DCT 502 are then quantized in quantizer Q 503 and may further be coded in the quantizer Q 503. These coded coefficients are then transmitted to a decoder as FAC parameters. The FAC parameters comprise quantized DCT coefficient, which then become, at the decoder, the input of an inverse transform, for example an IDCT 504, used to form a time-domain signal. This time-domain signal may then be filtered through the inverse filter $1/W_1(z)$ 505 which has a zero initial state. Filtering through the inverse filter $1/W_1(z)$ 505 is extended past the length of the first FAC target part 432 using zero-input for the samples that extend after the first FAC target part 432. The output of the inverse filter $1/W_1(z)$ is a first FAC synthesis part 506, which is a correction signal that may now be applied at the beginning of the TC frame 402 to compensate for the windowing and time-domain aliasing effects.

Now, turning to the processing for the windowing and time-domain aliasing correction at the end of the TC frame 402, before marker LPC2, the bottom part of FIG. 5 is considered. The second FAC target part 434, at the end of the TC frame 402 on line 4 of FIG. 4, may be filtered through a weighting filter $W_2(z)$ computed from the second LPC filter calculated at frame boundary LPC2 or an interpolated LPC filter using both the first LPC filter calculated at frame boundary LPC1 and the second LPC filter calculated at filter boundary LPC2. The second LPC filter calculated at frame boundary LPC2 has as an initial state, or filter memory, formed by the transform coding error in the TC frame on line 4 of FIG. 4. Then all further processing operations are the same as for the upper part of FIG. 5 (see DCT 508, quantizer Q 509, IDCT 510, and inverse weighting filter $1/W_2(z)$ 511), which dealt with the processing of the FAC target at the beginning of the TC frame 402, except for the use of weighting filter $W_2(z)$ instead of weighting filter $W_1(z)$), providing a second FAC synthesis part 512.

The entire process of FIG. 5 is performed when applied at the coder, in order to obtain the local FAC synthesis. At the decoder, the processing of FIG. 5 is only applied from a point where the FAC parameters, received from the quantizer Q 503 or 509 of the coder, are used as input in the IDCT. This also produces a FAC synthesis at the decoder.

Figure 6:
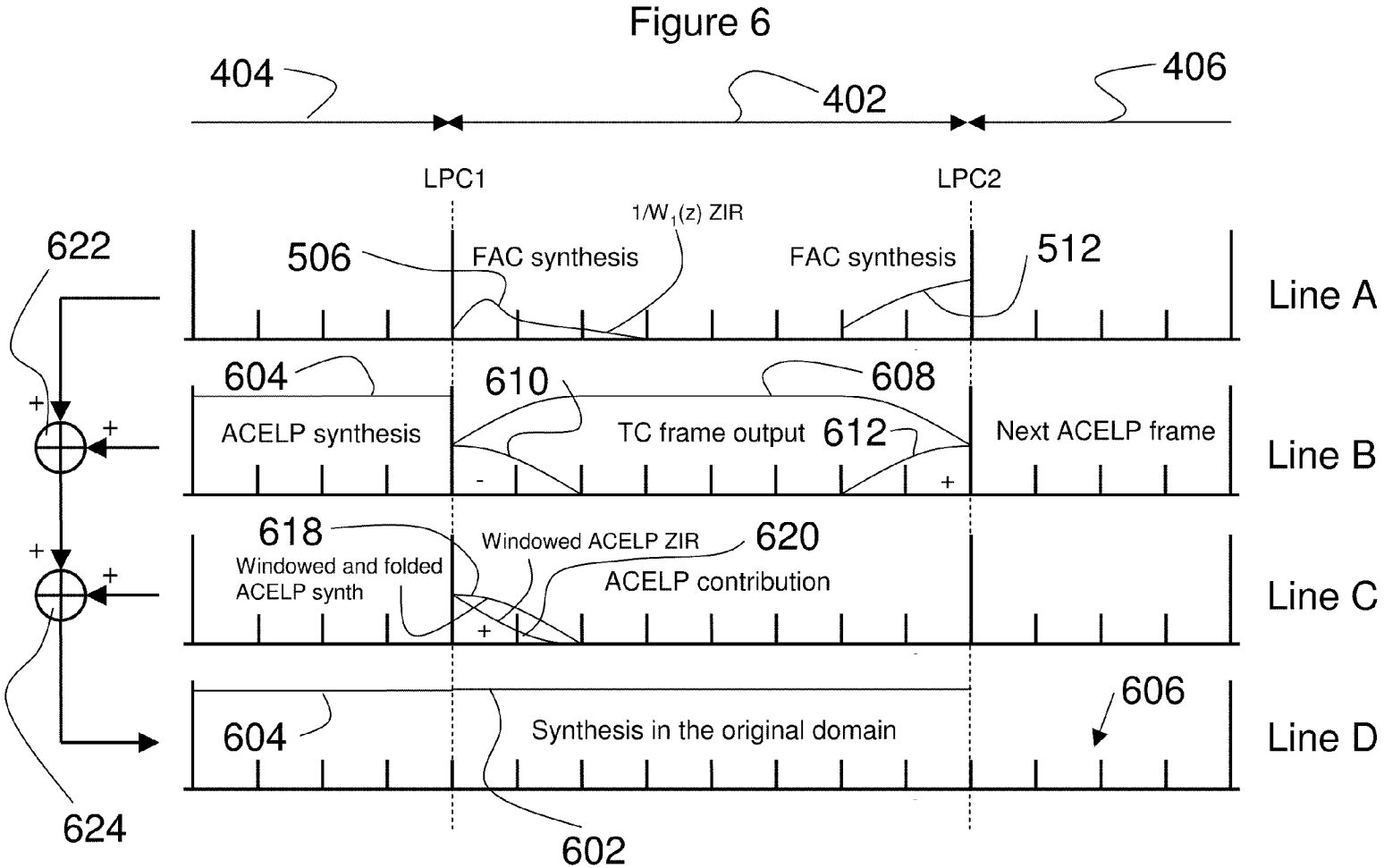
FIG. 6 is a schematic diagram of a sequence of operations of an exemplary method of computing a synthesis of an audio signal, using FAC parameters representative of the FAC target of FIG. 4.

FIG. 6 is a schematic diagram of a sequence of operations of an exemplary method of computing a synthesis of an original audio signal, using FAC parameters representative of the FAC target of FIG. 4. Computation of the synthesis is made in the original domain using FAC. Usage of LPC allows the FAC to be used in the context of FDNS for example as described in PCT application No. PCT/CA2010/001649 filed on Oct. 15, 2010 and entitled "SIMULTANEOUS TIME-DOMAIN AND FREQUENCY-DOMAIN NOISE SHAPING FOR TDAC TRANSFORMS". Potential discontinuities are masked by the inverse filtering as it is done in the context of TCX using LPC. FIG. 6 shows how a complete synthesis signal 604, 602, 606 can be obtained by using the FAC synthesis as shown in FIG. 5 and applying an inverse of the operations of FIG. 4. In FIG. 6, the ACELP frame 404 at the left of marker LPC1 is already synthesized up to marker LPC1, shown as ACELP synthesis 604 on line B. The frame 406 after marker LPC2 is also an ACELP frame. Then, to produce a synthesis signal 602 in the TC frame 402, between markers LPC1 and LPC2, the following steps are performed:

The received MDCT-coded TC frame 402 is decoded by IMDCT and a resulting time-domain signal 608 is produced between markers LPC1 and LPC2 as shown on line B of FIG. 6. This decoded TC frame 402 contains windowing and time-domain aliasing effects 610, 612.

The FAC synthesis signal 506, 512 as in FIG. 5 is positioned at the beginning and end of the TC frame 402. More specifically, received FAC parameters are decoded, if applicable, inverse transformed, for example using IDCT (504, 510), and filtered using filter $1/W_1(z)$ 505 for the first part 506 and filter $1/W_2(z)$ 511 for the second part 512. This produces two FAC synthesis parts 506, 512 as illustrated in FIG. 5. The first FAC synthesis part 506 is positioned at the beginning of the TC frame 402 on line A, and the second FAC synthesis part 512 is positioned at the end of the TC frame 402 on line A.

The windowed and folded (time-inverted) ACELP synthesis 618 from the ACELP frame 404 preceding the TC frame 402 and the ZIR 620 of the ACELP synthesis filter are positioned at the beginning of the TC frame 402. This is shown on line C.

Lines A, B and C are added through adders 622 and 624 to form the synthesis signal 602 for the TC frame in the original domain on line D. This processing has produced, in the TC frame 402, the synthesis signal 602 where time-domain aliasing and windowing effects have been cancelled at the beginning and end of the frame 402, and where the potential discontinuity at the frame boundary around marker LPC1 may further have been smoothed and perceptually masked by the filters $1/W_1(z)$ 505 and $1/W_2(z)$ 511 of FIG. 5.

Of course, the addition of the signals from lines A to C can be performed in any order without changing the result of the processing described.

FAC may also be applied directly to the synthesis output of the TC frame without any windowing at the decoder. In this case, the shape of the FAC is adapted to take into account the different windowing (or lack of windowing) of the decoded TC frame 402.

The length of the FAC frame can be changed during coding. For example, exemplary frame lengths may be 64 or 128 samples depending on the nature of the signal. For example a shorter FAC frame may be used in case of unvoiced signals. Information about the length of the FAC frame can be signaled to the decoder, using for example a 1-bit indicator, or flag, to indicate 64 or 128-sample frames. An example of transmission sequence with signaling FAC length may comprise the following suite:

TC with overlap (256 bits)

FAC+signaling FAC length (128 bits)

ACELP

FAC+signaling FAC length (64 bits)

TC with overlap (128 bits)

Further signaling information may be transmitted to indicate certain processing functions to be performed by the decoder. An example is the signaling of the activation of post-processing, specific to ACELP frames. The post-processing can be switched on or off for a certain period consisting of several consecutive ACELP frames. In a transition from TC to ACELP, a 1-bit flag may be included within the FAC information to signal the activation of post-processing. In an embodiment, this flag is only transmitted in a first frame in a sequence of several ACELP frames. Thus the flag may be added to the FAC information, which is also sent for the first ACELP frame.

Figure 7:
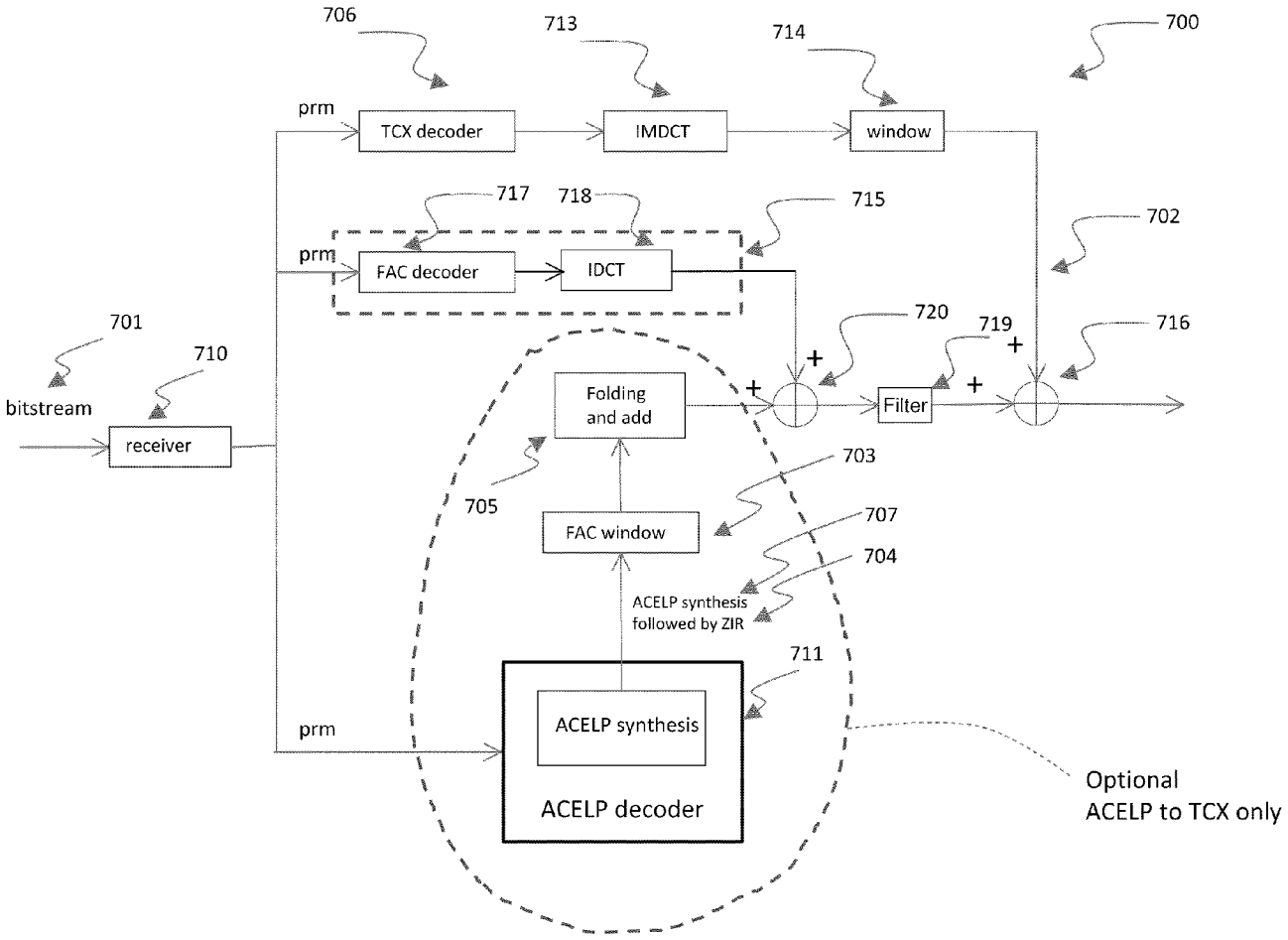
FIG. 7 is a schematic block diagram of a non-limitative example of device for forward cancelling time-domain aliasing in a coded audio signal received in a bitstream.

FIG. 7 is a block diagram of a non-limitative example of device for forward cancelling time-domain aliasing in a coded audio signal received in a bitstream. A device 700 is given, for the purpose of illustration, with reference to the FAC target of FIGS. 5 and 6, using information from the ACELP mode. Those of ordinary skill in the art will appreciate that a corresponding device 700 can be implemented in relation to every other example of coding modes and FAC correction given in the present disclosure.

The device 700 comprises a receiver 710 for receiving a bitstream 701 representative of a coded audio signal including the FAC parameters representative of the FAC target.

Parameters (prm) for ACELP frames from the bitstream 701 are supplied from the receiver 710 to an ACELP decoder 711 including an ACELP synthesis filter. The ACELP decoder 711 produces a zero-input-response (ZIR) 704 of the ACELP synthesis filter. Also, the ACELP synthesis decoder 711 produces an ACELP synthesis signal 702. The ACELP synthesis signal 702 and the ZIR 704 are concatenated to form an ACELP synthesis signal followed by the ZIR. A FAC window 703, having characteristics matching the windowing applied on FIG. 6, line C, is then applied to the concatenated signals 707 and 704. The ACELP synthesis signal 707 is windowed and folded to produce the ACELP synthesis 618 of line C of FIG. 6 while the ZIR 704 is windowed to produce the ACELP ZIR 620 of FIG. 6. Both are added in processor 705, and then applied to a positive input of an adder 720 to provide a first (optional) part of the audio signal in TCX frames.

Parameters (prm) for TCX 20 frames from the bitstream 701 are supplied to a TCX decoder 706, followed by an IMDCT transform 713 and a window 714 for the IMDCT, to produce a TCX 20 synthesis signal 702 (see 608, 610 and 612 of line B FIG. 6) applied to a positive input of an adder 716 to provide a second part of the audio signal in TCX 20 frames.

However, upon a transition between coding modes (for example from an ACELP frame to a TCX 20 frame), a part of the audio signal would not be properly decoded without the use of a FAC processor 715. In the example of FIG. 7, the FAC processor 715 comprises a FAC decoder 717 for decoding from the received bitstream 701 the FAC parameters (output of DCT 502 and 508 of FIG. 5), which corresponds to the FAC target after filtering (see filters 501 and 507 of FIG. 5) and DCT transform (see DCT 502 and 508 of FIG. 5), as produced by the quantizer Q (503, 509) of FIG. 5. An IDCT 718 (corresponding to IDCT 504 and 505 of FIG. 5) applies an inverse DCT to the decoded FAC parameters from the decoder 717, and the output of the IDMCT 718 is supplied to a positive input of the adder 720. The output of the adder 720 is supplied to a filter 719, which applies characteristics of the inverse weighting filter $1/W_1(z)$ (505 of FIG. 5) to a first part (corresponding to 432 of FIG. 5) of the FAC target and those of the inverse weighting filter $1/W_2(z)$ (511 of FIG. 5) to a second part (corresponding to 434 of FIG. 5) of the FAC target. The output of the filter 719 is supplied to a positive input of the adder 716.

The global output of the adder 716 represents the FAC cancelled synthesis signal (602 of FIG. 6) for a TCX frame following an ACELP frame.

Figure 8:
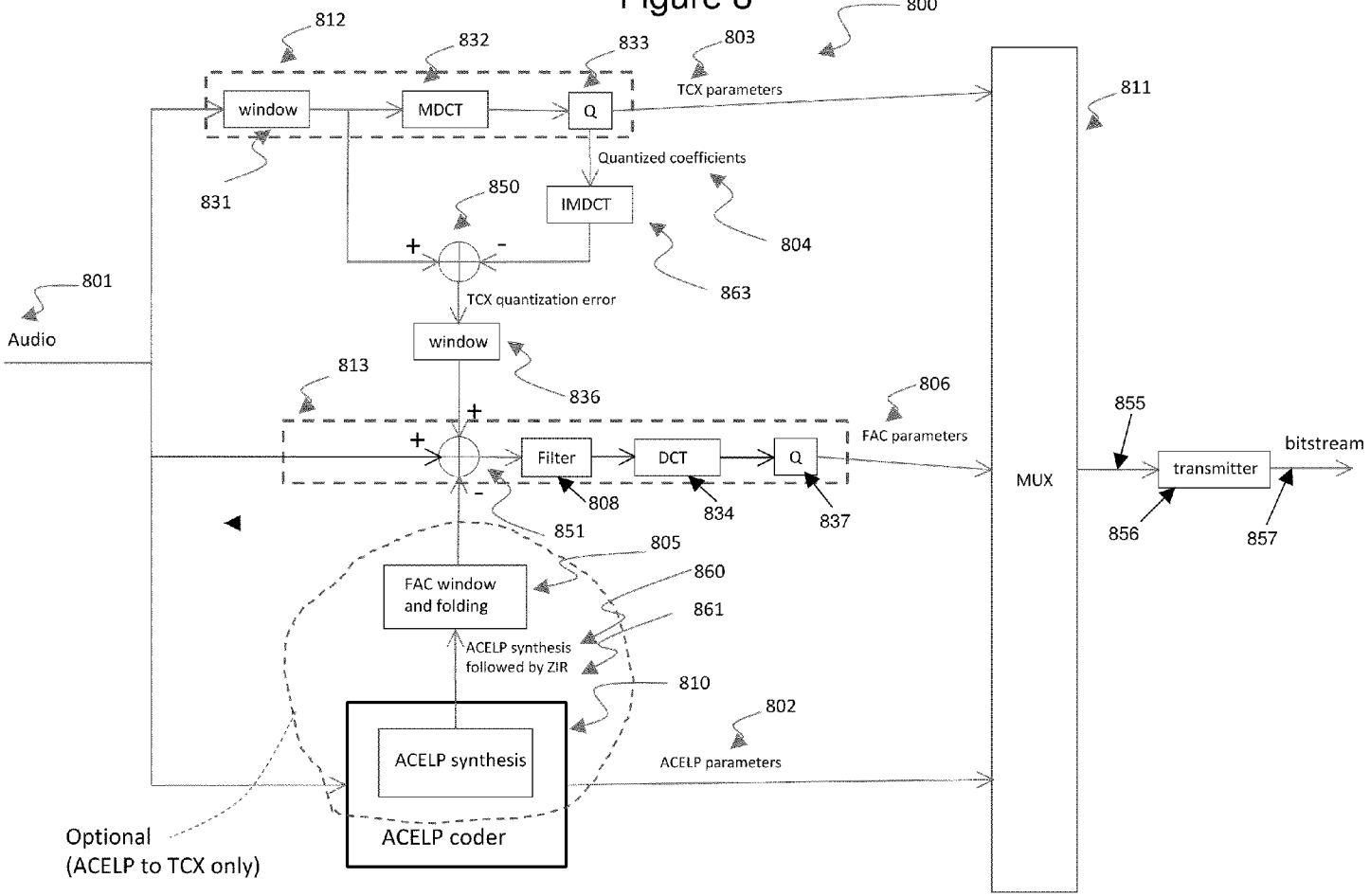
FIG. 8 is a block diagram of a non-limitative example of device for forward time-domain aliasing cancellation in a coded audio signal for transmission to a decoder.

FIG. 8 is a schematic block diagram of a non-limitative example of device 800 for forward time-domain aliasing cancellation in a coded signal for transmission to a decoder. The device 800 is given, for the purpose of illustration, with reference to the FAC target of FIGS. 4 and 5, using information from the ACELP mode. Those of ordinary skill in the art will appreciate that a corresponding device 800 can be implemented in relation to every other example of coding modes and FAC correction given in the present disclosure.

An audio signal 801 to be coded is applied to the device 800. A logic (not shown) applies ACELP frames of the audio signal 801 to an ACELP coder 810. An output of the ACELP coder 810, the ACELP-coded parameters 802, is applied to a first input of a multiplexer (MUX) 811 for transmission to a receiver (not shown). Another output of the ACELP coder is an ACELP synthesis signal 860 followed by the zero-input response (ZIR) 861 of an ACELP synthesis filter forming part of the ACELP coder 810. A FAC window 805 having characteristics matching the windowing applied on FIG. 4, line 3, is applied by a FAC window processor 805 to the concatenation of signals 860 and 861. The output (corresponding to FIG. 4, line 3) of the FAC window processor 805 is applied to a negative input of an adder 851 (corresponding to adder 427 of FIG. 4).

The logic (not shown) also applies TCX 20 frames (see frame 402 of FIG. 4) of the audio signal 801 to a MDCT coding module 812 to produce the TCX 20 coded parameters 803 applied to a second input of the multiplexer 811 for transmission to a receiver (not shown). The MDCT coding module 812 comprises an MDCT window 831, an MDCT transform 832, and a quantizer 833. The audio signal 801 is windowed by the MDCT window 831 and the MDCT-windowed signal is supplied from the MDCT window 831 to a positive input of an adder 850 (corresponding to adder 426 of FIG. 4). The MDCT-windowed signal from the MDCT window 831 is also supplied to an MDCT to produce MDCT coefficients supplied to a quantizer 833 to produce the TCX parameter 803 and quantized MDCT coefficients 804 applied to an inverse MDCT (IMDCT) 833. The output of the IMDCT 833 is a synthesis signal (corresponding to synthesis signal 412 of FIG. 4) supplied to a negative input of the adder 850 (corresponding to adder 426 of FIG. 4). The output of the adder 850 forms a TCX quantization error, which is windowed in processor 836. The output of processor 836 is supplied to a positive input of the adder 851.

Upon a transition between coding modes (for example from an ACELP frame to a TCX 20 frame), some of the audio frames coded by the MDCT module 812 may not be properly decoded without additional information. A calculator 813 provides this additional information, more specifically a coded and quantized FAC target. All components of the calculator 813 may be viewed as a producer of FAC parameters 806. The output of adder 851 is the FAC target (corresponding to line 4 of FIG. 4). The FAC target is input into a filter 808, which applies characteristics of the weighting filter $W_1(z)$ 501 (FIG. 5) to the first part 432 of the FAC target and those of the weighting filter $W_2(z)$ 507 (FIG. 5) to the second part 434 of the FAC target. The output of the filter 804 is then applied to the DCT 834 (corresponding to DCT 502 and 508 of FIG. 5), followed by quantizing the output of DCT 834 in quantizer 837 (corresponding to quantizers 503 and 509 of FIG. 5) to produce the FAC parameters 806 which are applied to an input of multiplexer 811 for transmission to a receiver (not shown).

The signal at the output of the multiplexer 811 represents the coded audio signal 855 to be transmitted to a receiver (not shown) through a transmitter 856 in a coded bitstream 857.

Those of ordinary skill in the art will realize that the description of the device and method for forward cancelling time-domain aliasing in a coded signal are illustrative only and are not intended to be in any way limiting. Other embodiments will readily suggest themselves to such persons with ordinary skill in the art having the benefit of this disclosure. Furthermore, the disclosed device and method can be customized to offer valuable solutions to existing needs and problems of cancelling time-domain aliasing in a coded signal.

Those of ordinary skill in the art will also appreciate that numerous types of terminals or other apparatuses may embody both aspects of coding for transmission of coded audio, and aspects of decoding following reception of coded audio, in a same device.

In the interest of clarity, not all of the routine features of the implementations of forward cancellation of time-domain aliasing in a coded signal are shown and described. It will, of course, be appreciated that in the development of any such actual implementation of the audio coding, numerous implementation-specific decisions must be made in order to achieve the developer's specific goals, such as compliance with application-, system-, network- and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of audio coding systems having the benefit of this disclosure.

In accordance with this disclosure, the components, process steps, and/or data structures described herein may be implemented using various types of operating systems, computing platforms, network devices, computer programs, and/or general purpose machines. In addition, those of ordinary skill in the art will recognize that devices of a less general purpose nature, such as hardwired devices, field programmable gate arrays (FPGAs), application specific integrated circuits (ASICs), or the like, may also be used. Where a method comprising a series of process steps is implemented by a computer or a machine and those process steps can be stored as a series of instructions readable by the machine, they may be stored on a tangible medium.

Systems and modules described herein may comprise software, firmware, hardware, or any combination(s) of software, firmware, or hardware suitable for the purposes described herein. Software and other modules may reside on servers, workstations, personal computers, computerized tablets, PDAs, and other devices suitable for the purposes described herein. Software and other modules may be accessible via local memory, via a network, via a browser or other application in an ASP context or via other means suitable for the purposes described herein. Data structures described herein may comprise computer files, variables, programming arrays, programming structures, or any electronic information storage schemes or methods, or any combinations thereof, suitable for the purposes described herein.

Although the present disclosure has been described hereinabove by way of non-restrictive illustrative embodiments thereof, these embodiments can be modified at will within the scope of the appended claims without departing from the spirit and nature of the present disclosure.

What is claimed is:

1. A method for producing forward aliasing cancellation (FAC) parameters for cancelling time-domain aliasing caused to a coded audio signal in a first transform-coded frame by a transition between the first transform-coded frame using a first coding mode with overlapping window and a second frame using a second coding mode with non-overlapping window, wherein the second frame precedes the first frame, comprising:

calculating, in a coder, a FAC target representative of a difference between (a) the audio signal of the first frame prior to coding and (b) a sum of:

a synthesis of the coded audio signal of the first transform-coded frame containing a folding effect formed by a windowed and folded portion of a synthesis of the coded audio signal in the second frame subtracted from or added to the synthesis of the first frame, a windowed and time-reversed version of last synthesis samples of the second frame, and a windowed zero-input response of a synthesis filter used in the second frame;

and weighting, in the coder, the FAC target to produce the FAC parameters, the FAC parameters forming additional information for transmission from the coder to a decoder and for use by the decoder as a basis in cancelling the time-domain aliasing in the synthesis of the coded audio signal at the transition between the first transform-coded frame using the first coding mode with overlapping window and the second frame using the second coding mode with non-overlapping window.

2. A method for forward cancelling time-domain aliasing caused to a coded audio signal in a first transform-coded frame by a transition between the first transform-coded frame using a first coding mode with overlapping window and a second frame using a second coding mode with non-overlapping window, comprising:

receiving weighted forward aliasing cancellation (FAC) parameters produced using the method of claim 1;

inverse weighting the weighted FAC parameters to produce a FAC synthesis; and upon synthesis of the coded audio signal in the first frame, cancelling the time-domain aliasing from the audio signal synthesis using the FAC synthesis.

3. A method as defined in claim 2, wherein the received FAC parameters are transformed, weighted FAC parameters, and wherein the method comprises inverse transforming the transformed, weighted FAC parameters by applying to said transformed, weighted FAC parameters an inverse coding transform to produce inverse transformed, weighted FAC parameters.

4. A method as defined in claim 3, wherein inverse transforming the transformed, weighted FAC parameters comprises applying an inverse DCT transform to the transformed, weighted FAC parameters in view of producing inverse transformed, weighted FAC parameters.

5. A Method as defined in claim 2, wherein the FAC synthesis comprises a FAC synthesis part adjacent the second frame, and wherein inverse weighting the weighted FAC parameters comprises processing the weighted FAC parameters through an inverse weighting filter.

6. A method as defined in claim 5, comprising deriving the inverse weighting filter from an LPC filter used to shape a coding noise in the first transform-coded frame.

7. A method as defined in claim 2, wherein cancelling the time-domain aliasing comprises adding the FAC synthesis and a synthesis of the coded audio signal of the first transform-coded frame.

8. A method as defined in claim 7, wherein the second frame precedes the first frame, and wherein the method further comprises adding to the addition of the FAC synthesis to the synthesis of the coded audio signal of the first transform-coded frame, contributions comprising a windowed and time-reversed version of last synthesis samples of the second frame, and a windowed zero-input response of a synthesis filter used in the second frame.

9. A method as defined in claim 2, wherein the first frame is an MDCT-based transform-coded frame and the second frame is an ACELP frame.

10. A method as defined in claim 9, wherein frequency-domain noise shaping (FDNS) is applied to the MDCT-based transform-coded frame.

11. A method as defined in claim 2, wherein the second frame is an ACELP frame and wherein inverse weighting the weighted FAC parameters comprises processing the weighted FAC parameters through an inverse weighting filter derived from an LPC filter calculated at a boundary between the first and second frames.

12. A method as defined in claim 1, wherein the FAC target comprises a FAC target part adjacent the second frame, and wherein weighting the FAQ target comprises processing the first FAC target part through a weighting filter.

13. A method as defined in claim 12, comprising deriving the weighting filter from an LPC filter used to shape a coding noise in the first transform-coded frame.

14. A method as defined in claim 1, wherein the first frame is an MDCT-based transform-coded frame and the second frame is an ACELP frame.

15. A method as defined in claim 14, wherein frequency-domain noise shaping (FDNS) is applied to the MDCT-based transform-coded frame.

16. A method as defined in claim 1, comprising transforming the weighted FAC target by applying a coding transform to the weighted FAC target.

17. A method as defined in claim 1, wherein the second frame is an ACELP frame and wherein weighting the FAC target comprises processing the FAC target through a weighting filter derived from an LPC filter calculated at a boundary between the first and second frames.

18. A method as defined in claim 1, further comprising:

transforming the weighted FAC target by applying a DCT transform to the weighted FAC target.

19. A method as defined in claim 1, wherein the weighting filter is derived from an LPC filter interpolated using both (a) a first LPC filter calculated using a first analysis window at a first boundary between the first and second frames and (b) a second LPC filter calculated using a second analysis window at a second boundary between the first frame and a third frame.

20. A method as defined in claim 1, wherein weighting the FAC target comprises processing the FAC target through a weighting filter calculated using an analysis window centered on a boundary between the first and second frames.

21. A device for producing forward aliasing cancellation (FAC) parameters for cancelling time-domain aliasing caused to a coded audio signal in a first transform-coded frame by a transition between the first transform-coded frame using a first coding mode with overlapping window and a second frame using a second coding mode with non-overlapping window, wherein the second frame precedes the first frame, comprising:

in a coder, a calculator of a FAC target representative of a difference between (a) the audio signal of the first frame prior to coding and (b) a sum of:

a synthesis of the coded audio signal of the first transform-coded frame containing a folding effect formed by a windowed and folded portion of a synthesis of the coded audio signal in the second frame subtracted from or added to the synthesis of the first frame, a windowed and time-reversed version of last synthesis samples of the second frame, and a windowed zero-input response of a synthesis filter used in the second frame; and in the coder, a weighting filter supplied with the FAC target to produce the FAC parameters, the FAC parameters forming additional information for transmission from the coder to a decoder and for use by the decoder as a basis in canceling the time-domain aliasing in the synthesis of the coded audio signal at the transition between the first transform-coded frame using the first coding mode with overlapping window and the second frame using the second coding mode with non-overlapping window.

22. A device for forward cancelling time-domain aliasing caused to a coded audio signal in a first transform-coded frame by a transition between the first transform-coded frame using a first coding mode with overlapping window and a second frame using a second coding mode with non-overlapping window, comprising:

an input for receiving weighted forward aliasing cancellation (FAC) parameters produced using the device of claim 21;

an inverse weighting filter supplied with the weighted FAC parameters to produce a FAC synthesis; and a decoder of the coded audio signal responsive to the FAC synthesis to produce in the first frame an audio signal synthesis with cancelled time-domain aliasing.

23. A device as defined in claim 22, wherein the received FAC parameters are transformed, weighted FAC parameters, and wherein the device comprises an inverse transform applied to the transformed, weighted FAC parameters to produce inverse transformed, weighted FAC parameters.

24. A device as defined in claim 23, wherein the inverse transform is an inverse DCT transform.

25. A device as defined in claim 22, wherein the decoder comprises, to cancel the time-domain aliasing, and adder of the FAC synthesis to the synthesis of the coded audio signal of the first transform-coded frame.

26. A device as defined in claim 25, wherein the second frame precedes the first frame, and wherein the device further comprises an adder for adding to the addition of the FAC synthesis to the synthesis of the coded audio signal of the first transform-coded frame, contributions comprising a windowed and time-reversed version of last synthesis samples of the second frame, and a windowed zero-input response of a synthesis filter used in the second frame.

27. A device as defined claim 22, wherein the first frame is an MDCT-based transform-coded frame and the second frame is an ACELP frame.

28. A device as defined in claim 27, wherein frequency-domain noise shaping (FDNS) is applied to the MDCT-based transform-coded frame.

29. A device as defined in claim 22, wherein the FAC synthesis comprises a FAC synthesis part adjacent the second frame and wherein the inverse weighting filter is derived from an LPC filter used to shape a coding noise in the first transform-coded frame.

30. A device as defined in claim 22, wherein the second frame is an ACELP frame and wherein the inverse weighting filter is derived from an LPC filter calculated at a boundary between the first and second frames.

31. An audio signal decoder, comprising:

a first decoder of the audio signal coded in a first transform coding mode using frames with overlapping windows;

a second decoder of the audio signal coded in a second coding mode using frames with non-overlapping windows; and a device as defined in claim 22, for forward cancelling time-domain aliasing caused to the audio signal coded using the first coding mode in a frame with overlapping window by a transition between the first frame using the first coding mode with overlapping window and a second frame using the second coding mode with non-overlapping window.

32. A device as defined in claim 21, comprising a coding transform applied to the weighted FAC target.

33. A device a defined in claim 32, wherein the coding transform is a DCT transform.

34. A device as defined in claim 21, wherein the first frame is an MDCT-based transform-coded frame and the second frame is an ACELP frame.

35. A device as defined in claim 34, wherein frequency-domain noise shaping (FDNS) is applied to the MDCT-based transform-coded frame.

36. A device as defined in claim 21, wherein the FAC target comprises a FAC target part adjacent the second frame, and wherein the weighting filter is derived from an LPC filter used to shape a coding noise in the first transform-coded frame.

37. A device as defined in claim 21, wherein the second frame precedes the first frame, and wherein the device further comprises an adder for subtracting from the difference between the audio signal of the first frame prior to coding and the synthesis of the coded audio signal of the first transform-coded frame, contributions comprising a windowed and time-reversed version of last synthesis samples of the second frame and a windowed zero-input response of a synthesis filter used in the second frame.

38. A device is defined in claim 21, wherein the second frame is an ACELP frame and wherein the weighting filter is derived from an LPC filter calculated at a boundary between the first and second frames.

39. An audio signal coder, comprising:

a first coder of the audio signal in a first transform coding mode using frames with overlapping windows;

a second coder of the audio signal in a second coding mode using frames with non-overlapping windows; and a device as defined in claim 21 for producing FAC parameters for cancelling time-domain aliasing caused to the audio signal coded in the first coding mode in a first frame with overlapping window by a transition between the first frame using the first coding mode with overlapping window and a second frame using the second coding mode with non-overlapping window.

40. A device as defined in claim 21, wherein the weighting filter is derived from an LPC filter interpolated using both (a) a first LPC filter calculated using an analysis window at a first boundary between the first and second frames and (b) a second LPC filter calculated using a second analysis window at a second boundary between the first frame and a third frame.

41. A device as defined in claim 21, wherein the weighting filter is calculated using an analysis window centered on a boundary between the first and second frames.

* * * * *